US008083923B2

(12) United States Patent
Jones

(10) Patent No.: US 8,083,923 B2
(45) Date of Patent: Dec. 27, 2011

(54) ELECTRODE STRUCTURE FOR PROTECTION OF STRUCTURAL BODIES

(75) Inventor: Graeme Jones, Whalley Range (GB)

(73) Assignee: Sika Technology AG, Baar (CH)

( * ) Notice: Subject to any disclaimer, the term of this patent is extended or adjusted under 35 U.S.C. 154(b) by 1035 days.

(21) Appl. No.: 10/498,159

(22) PCT Filed: Dec. 6, 2002

(86) PCT No.: PCT/GB02/05545

§ 371 (c)(1),
(2), (4) Date: Mar. 4, 2005

(87) PCT Pub. No.: WO03/050325

PCT Pub. Date: Jun. 19, 2003

(65) Prior Publication Data

US 2005/0166540 A1 Aug. 4, 2005

(30) Foreign Application Priority Data

Dec. 8, 2001 (GB) ..... 0129431.3

(51) Int. Cl.
*C23F 13/00* (2006.01)

(52) U.S. Cl. ..... 205/734; 204/196.17; 204/196.3; 428/408

(58) Field of Classification Search ..... 204/196.1, 204/196.17, 196.3, 196.37; 205/734; 428/408
See application file for complete search history.

(56) References Cited

U.S. PATENT DOCUMENTS

| | | | | |
|---|---|---|---|---|
| 4,506,485 | A * | 3/1985 | Apostolos | 52/515 |
| 4,588,443 | A * | 5/1986 | Bache | 106/644 |
| 4,957,612 | A * | 9/1990 | Stewart et al. | 204/196.38 |
| 4,990,231 | A * | 2/1991 | Stewart et al. | 205/734 |
| 5,100,738 | A * | 3/1992 | Graf | 428/613 |
| 5,183,694 | A * | 2/1993 | Webb | 205/734 |
| 5,309,638 | A * | 5/1994 | Farber et al. | 29/897.34 |
| 6,316,074 | B1 * | 11/2001 | Kaiser et al. | 428/76 |
| 6,958,116 | B1 * | 10/2005 | Bennett | 205/734 |

FOREIGN PATENT DOCUMENTS

EP 147977 A2 * 7/1985

OTHER PUBLICATIONS

Definition of grout from the internet site www.lehighcement.com/Education/Lehigh-Education-Glossary.htm.*
Definition of concrete from the internet site wordnetweb.princeton.edu/perl/webwn.*

* cited by examiner

*Primary Examiner* — Brian Glessner
*Assistant Examiner* — Adriana Figueroa
(74) *Attorney, Agent, or Firm* — Oliff & Berridge, PLC

(57) ABSTRACT

Electrolytic protection of steel-reinforced concrete bodies such as bridges and building facades is achieved with carbon material (3, 12, 23) inserted into the concrete body (6, 10, 21). The carbon material is connected to act as a anode with the steel reinforcement (1, 11, 22) as a cathode, so that corrosive chloride ions migrate away from the steel reinforcement. The carbon material is inserted so as also to act as a reinforcement. In one arrangement carbon textile material is provided between inner and outer grout-filled plastics ducts (2, 4, 5) fixed around post-tensioned steel cables (1). In another arrangement a carbon rod (12), or pin (23), is fixed between a concrete body (23) and a steel I-beam (22).

3 Claims, 3 Drawing Sheets

ELECTRODE STRUCTURE FOR PROTECTION OF STRUCTURAL BODIES

This invention relates to an electrode device for use in the electrolytic protection of structural bodies, particularly steel-reinforced concrete bodies.

BACKGROUND

Corrosion of steel reinforcements in concrete is much accelerated by the presence of chloride ions. This is particularly a problem where salt (sodium chloride) is used for de-icing of concrete road surfaces, which may percolate through the reinforced concrete.

It is well known to apply an electric current between the (cathodic) steel reinforcements and a closely adjacent anode device so as to encourage chloride ions to migrate away from the steel reinforcement.

It is required that the anode device should be made from a material which has adequate electrical properties, which is sufficiently durable to withstand long use in possibly adverse conditions, and which is suitable, in terms of cost and convenience of installation, for widespread use over large concrete areas.

One known material is a settable carbon gel injected into drilled holes with inserted primary anodes.

Another known material is a carbon paint applied as a surface coating.

A further known material is a titanium substrate which has a conductive mixed metal oxide coating, formed into a suitable shaped structure, such as a mesh, a ribbon or tubular structure.

A further known material is a conductive ceramic material formed as a tubular structure with an inserted electrical contact.

These known materials can have drawbacks in terms of operational efficiency and/or durability and/or convenience of manufacture or installation. In particular, there is the problem that they require introduction of additional structures into the structural body to be protected which may be inconvenient and could even impair structural integrity of the body.

SUMMARY

An object of the present invention is to provide an improved electrode device, particularly for use in the protection of civil engineering and building structures, having good durability and operational efficiency, and which can be conveniently incorporated in a structural body.

According to one aspect of the invention therefore there is provided an electrode device for electrolytic protection of a structural body such as a civil engineering or building structure, characterised in that the device comprises carbon material incorporated as a reinforcement in the structural body.

With this arrangement the electrode device performs dual functions of electrolytic protection and structural reinforcement whereby its incorporation in the body can be effected in a particularly convenient and advantageous manner.

By reinforcement is meant a structural strengthening or supporting effect such as to contribute to the overall strength or integrity of the structural body.

Whilst being significant, this contribution may be secondary to that of a main reinforcing material such as steel. Thus, preferably the structural body comprises a concrete body with main reinforcing steelwork and the reinforcement provided by the carbon material is secondary to that of the steelwork.

The incorporation of the carbon material may be effected during original construction of the structural body or subsequently as a repair e.g. where the structural body has become weakened due to corrosion of the main reinforcing material possibly giving rise to separation at an interface or connection with the main reinforcing material.

The reinforcement provided by the carbon material may be a consequence of its interaction with a binding material within which it is embedded such as to form a composite structure therewith.

Alternatively, the reinforcement provided by the carbon material may be a consequence of the structural linking or supporting properties of the carbon material itself. In this case the carbon material may be fixed relative to the structural body by means of a binding material or by any other suitable means.

The aforesaid binding material may be a cementitious material and/or a suitable (e.g. conductive) synthetic polymeric material or resin. The binding material may be the same material as a building material principally used for the structural body or it may be an additional material incorporated with the carbon reinforcing material in the body.

The carbon material may take any suitable form. In the case where it forms a composite structure with the binding material as aforesaid, preferably it is of a flexible textile nature i.e. of a fibrous or filamentary nature which may be used as discrete yarns or bundles of yarns or as a woven or otherwise constructed textile strip or sheet.

Other forms for the carbon material are also possible and in particular it may be of a rigid or self-supporting nature, particularly a solid body such as a solid rod, especially in the case where it is used, as aforesaid, for its linking or supporting properties arising from the carbon material itself.

DETAILED DESCRIPTION OF EMBODIMENTS

Figure 1:
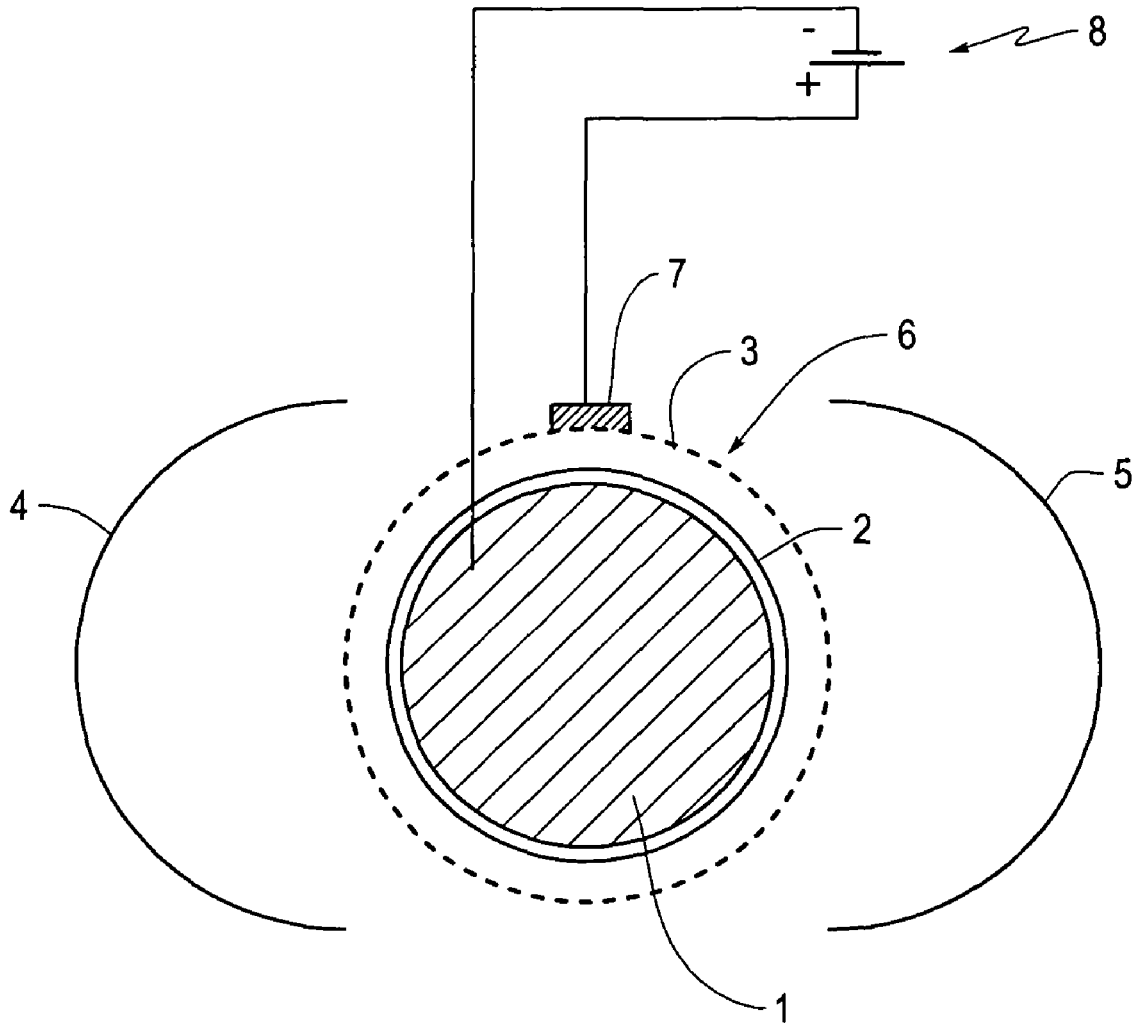
FIG. 1 represents a cross-section of an exemplary post-tensioned steel cable enclosed within a plastics duct.

In one preferred embodiment the carbon reinforcing material is used as, or part of, a sheath around a main reinforcement within the structural body. Thus, the carbon material may be applied as a tubular sheath around main elongate reinforcing elements, such as tensioned steel cables, by application around a duct, such as a plastics tube, which encloses the elongate reinforcing elements. The duct may be permeable e.g. perforated, deliberately, or as a consequence of fracture damage to provide an electrolytic passage therethrough. The carbon material sheath may itself be enclosed within a further outer cover or duct such as a plastics tube, which conveniently may be assembled from elongate sheets or halves, and internal spaces within the outer duct may be filled e.g. with suitable (e.g. conductive) polymeric and/or cementitious material, such as the aforesaid binding material.

In a further preferred embodiment the carbon reinforcing material is used as a linking member, or inserted anchor or tie or support to assist in holding the structural body in position. In this case, the carbon material may comprise a rod or tube or other elongate element which may be fixed between separable parts of the structural body, or between a part of the structural body and a main reinforcement such as a fixed steel structural I-beam or other support with as appropriate a cementitious or other infill therebetween. The carbon material may be bonded in position e.g. by cementitious bonding and/or may be bolted or otherwise mechanically fixed.

Thus, in one embodiment the elongate element extends at one end portion into a hole in the I-beam and is insulated relative thereto and extends at an opposite end portion into and is fixed within a passageway in said part of the structural body.

In a further embodiment, an elongate link member is fixed between the said part of the structural body and the main reinforcement and the said elongate element extends transversely to the link member between this and the said part of the structural body.

The invention may be applied to any suitable structural body including but not restricted to external and internal post-tensioned bridges, and building facades.

The carbon material may be positioned and electrically connected as desired in dependence on its intended use and environment e.g. in dependence on the form of the steel work in the case of steel-reinforced concrete structural bodies. Thus, the carbon material may be distributed and connected to establish multiple discrete electrodes extending throughout a zone where protection is required. Multiple electrodes may be established by using separate sections of the carbon material with insulation or gaps therebetween. Alternatively separation may be achieved by using separate sections of the same material which are sufficiently far apart that the inherent resistance of the material acts to achieve separation therebetween.

In accordance with conventional practice, in the case of concrete protection, the carbon material is preferably installed in close proximity (e.g. of the order of 25 mm) to the steel reinforcement and distributed widely over the area of such reinforcement. In so far as the carbon material is also used for reinforcing purposes associated with or in close proximity to the steel reinforcement, it may be necessary or desirable to interpose insulating and/or electrolytic (e.g. cementitious) material therebetween.

Also in accordance with conventional practice, especially in the case of concrete protection, the carbon material is preferably connected to the positive terminal of a d.c. power supply, main reinforcements such as steel work being connected to the negative terminal. The power supply may be local or remote and may be appropriately controlled as desired to maintain constant current or voltage or potential characteristics, and/or to interrupt power supply on a regular or irregular basis to minimise power consumption or monitor or otherwise.

Electrical connection to the carbon material may be achieved in any suitable manner and thus may involve conductors such as conductive coils or wires or strips or plates such as titanium strips pressed against or fixed to the carbon material.

Additionally or alternatively to the use of the carbon material as an electrode for introduction of electrolytic current, the carbon material may be used to provide a monitoring electrode or electrodes for monitoring the corrosion condition of steel reinforcement. Alternatively or additionally other electrodes different from the carbon material may be used for monitoring purposes.

The electrodes can be controlled and monitored to avoid the onset of hydrogen embrittlement e.g. by automatically reducing or extinguishing the application of protection current, without causing detrimental effect to strengthening capabilities. This can be achieved remotely e.g. through a suitable network link which may involve secure internet access.

The invention also provides a method of forming an electrode device for electrolytic protection of a structural body comprising concrete material reinforced with steelwork wherein carbon material is incorporated in the concrete material as a reinforcement therefor.

In one embodiment of the method the carbon material is incorporated into the preformed structural body after corrosion of the steelwork has occurred.

In a further embodiment wherein the steelwork comprises steel cables and the carbon material comprises flexible textile material which is wrapped around the cables.

In a further embodiment wherein the steelwork comprises an I-beam adjacent to the concrete material and the carbon material comprises a solid rod which is inserted through the concrete material into the I-beam to act as a link therebetween.

In a further embodiment wherein the steelwork comprises an I-beam adjacent to the concrete material, a metal rod is inserted through the concrete material into the I-beam, and the carbon material comprises a pin which is inserted transversely through the tie rod into the concrete material to act as a link therebetween.

The invention will now be described further by way of example only and with reference to the accompanying drawings FIGS. 1 to 3 which are schematic diagrams of alternative embodiments of the invention.

Referring to FIG. 1 this shows in cross-section post-tensioned steel cable 1 enclosed within a plastics duct 2, such as may be used in a bridge or other civil engineering structure.

Leakage through the duct 2 causing corrosion of the steel cable 1 is remedied by a repair involving application of carbon textile sheeting 3, e.g. woven sheeting, wrapped around the plastics duct 2.

This is held in position by fixing a further duct around the sheeting, assembled from two shells or half pipes 4, 5.

The interior of the outer duct defined by the shells 4, 5 is filled with grout 6.

The steel cables 1 are connected to negative polarity of a d.c. protection circuit 8. This can conveniently be achieved at a tendon anchor point or other easily accessible point along the cable.

The carbon material 3 is connected to positive polarity, e.g. via a titanium contact strip or conductor 7, applied to the carbon material.

The cementitious grout 6 within the outer duct 4, 5 and also within the duct 2 provides an electrolytic medium between the steel cables 1 and the carbon material 3. Passage of current through the duct 2 occurs as a consequence of passageways defined by breakage or cracking of the duct 2 and/or by deliberately provided perforations.

The carbon material 3 acts to provide support and strength around the breached inner duct 2 and also acts as an anode.

Figure 2:
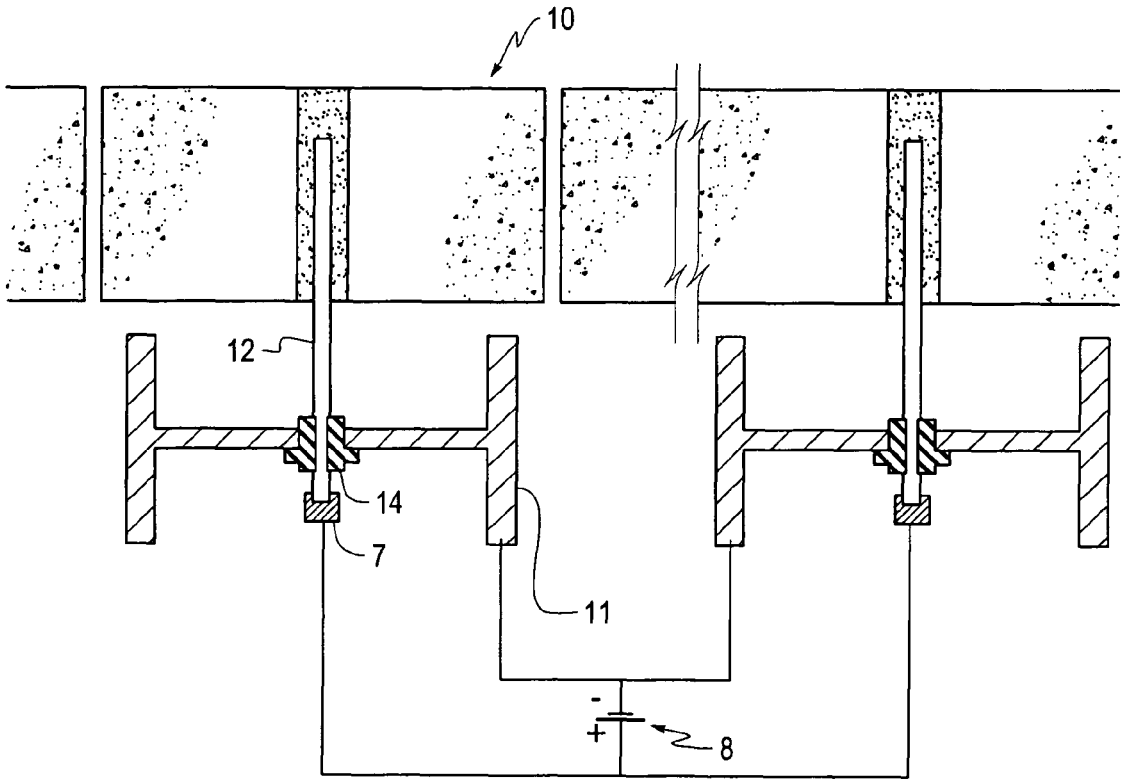
FIG. 2 represents an exemplary masonry facade and multiple electrolytic protection zones.

FIG. 2 shows a masonry façade 10 supported by a steel I-beam 11 in a building with a cementitious infill (not show) therebetween. FIG. 2 also shows multiple electrolytic protection zones.

In order to remedy unsafe detachment of the masonry 10 from the I-beam 11, a carbon link rod 12 is fixed between the masonry 10 and the I-beam 11.

At one end the rod 12 is fixed, by cementitious grout 13, in a bore in the masonry 10. At its other end the rod is fixed to the I-beam 11 by mechanical attachment through a hole in the beam, an insulating sleeve 14 being provided between the steel and the carbon rod 12.

The carbon rod 12 acts as a strengthening tie as well as an anode. The steel provides the cathode connection.

Figure 3:
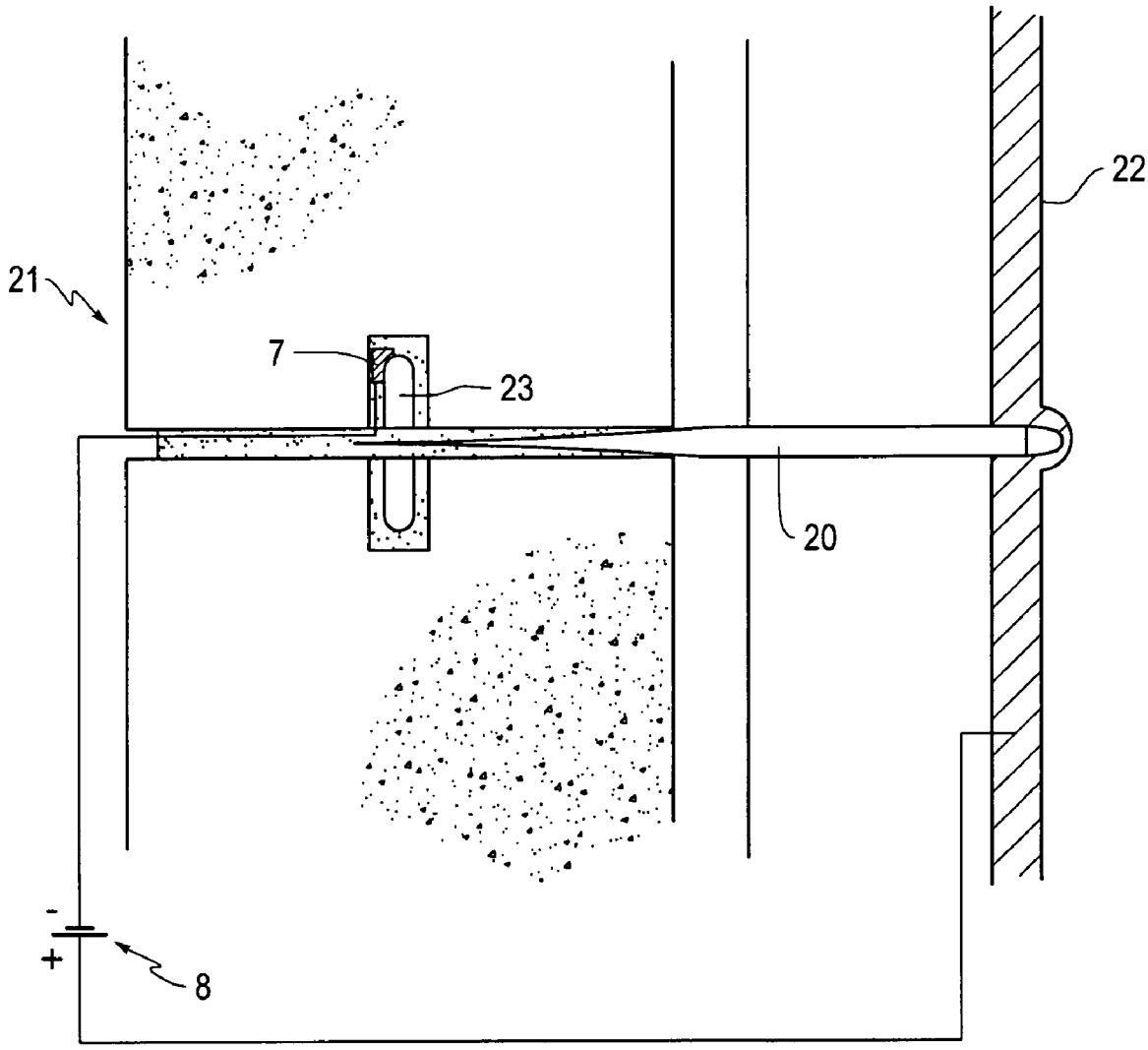
FIG. 3 represents an exemplary masonry facade repair.

FIG. 3 also shows a facade repair.

With FIG. 2 internal access is required.

With FIG. 3 only external access is required.

A steel link 20 is shot-fired to connect with the steel I-beam 22. This link 20 is anchored to the masonry 21 by means of a transverse carbon rod or pin 23 which is insulated from the steel link 20 by a suitable sleeve where it extends through the link 20.

The carbon rod 23 is connected as an anode and the steel link 20 as a cathode. A cementitious infill (not shown) is provided between the masonry 21 and the I-beam 11.

The invention is not intended to be restricted to the details of the above embodiments which are described by way of example only.

The invention claimed is:

1. An electrode device for electrolytic protection of a structural body, comprising:

a concrete body;

a main reinforcing steelwork embedded within the concrete body and acting as a cathode;

a secondary reinforcing carbon material, embedded at least in part within the concrete body, as a reinforcement in the structural body, and positioned in close proximity to the main reinforcing steelwork and acting as an anode, wherein the main reinforcing steelwork and the secondary reinforcing carbon material are configured to cooperate to provide structural reinforcement and electrolytic protection of the structural body, the carbon material forms at least part of a sheath around the main reinforcement of the structural body, the main reinforcement comprises elongate reinforcing elements, and the sheath is applied around an inner permeable duct which encloses the elongate elements.

2. A device according to claim 1 wherein the inner duct is a plastic tube.

3. An electrode device for electrolytic protection of a structural body, comprising:

a concrete body;

a main reinforcing steelwork embedded within the concrete body and acting as a cathode;

a secondary reinforcing carbon material incorporated as a reinforcement in the structural body in close proximity to the main reinforcing steelwork and acting as an anode, wherein the main reinforcing steelwork and the secondary reinforcing carbon material are configured to cooperate to provide structural reinforcement and electrolytic protection of the structural body, the carbon material forms at least part of a sheath around the main reinforcement of the structural body, the main reinforcement comprises elongate reinforcing elements, and the sheath is applied around an inner permeable duct which encloses the elongate elements.

* * * * *